United States Patent [19]

Fahlström

[11] 4,176,042

[45] Nov. 27, 1979

[54] METHOD OF TREATING SHALES

[75] Inventor: Per A. H. H. Fahlström, Akers Runö, Sweden

[73] Assignee: Boliden Aktiebolag, Stockholm, Sweden

[21] Appl. No.: 954,429

[22] Filed: Oct. 25, 1978

Related U.S. Application Data

[63] Continuation of Ser. No. 778,966, Mar. 18, 1977, abandoned.

[30] Foreign Application Priority Data

Mar. 25, 1976 [SE] Sweden ..... 7603646

[51] Int. Cl.[2] ..... C10G 1/04

[52] U.S. Cl. ..... 208/11 LE; 423/112; 423/113; 423/658.5

[58] Field of Search ..... 208/11 LE, 11 R; 423/87, 119, 658.5, 112, 113

[56] References Cited

U.S. PATENT DOCUMENTS

| | | | |
|---|---|---|---|
| 2,911,349 | 11/1959 | Coulson | 208/11 R |
| 3,503,868 | 3/1970 | Shields | 208/11 R |

*Primary Examiner*—Herbert Levine

*Attorney, Agent, or Firm*—Stevens, Davis, Miller & Mosher

[57] ABSTRACT

Kerogen-containing shale is crushed and comminuted to a fineness sufficient to free kerogen and any sulphides present in said shale. To enable the shale to be finely-divided more readily, the crushed shale is subjected to a leaching treatment prior to final comminution thereof.

13 Claims, 1 Drawing Figure

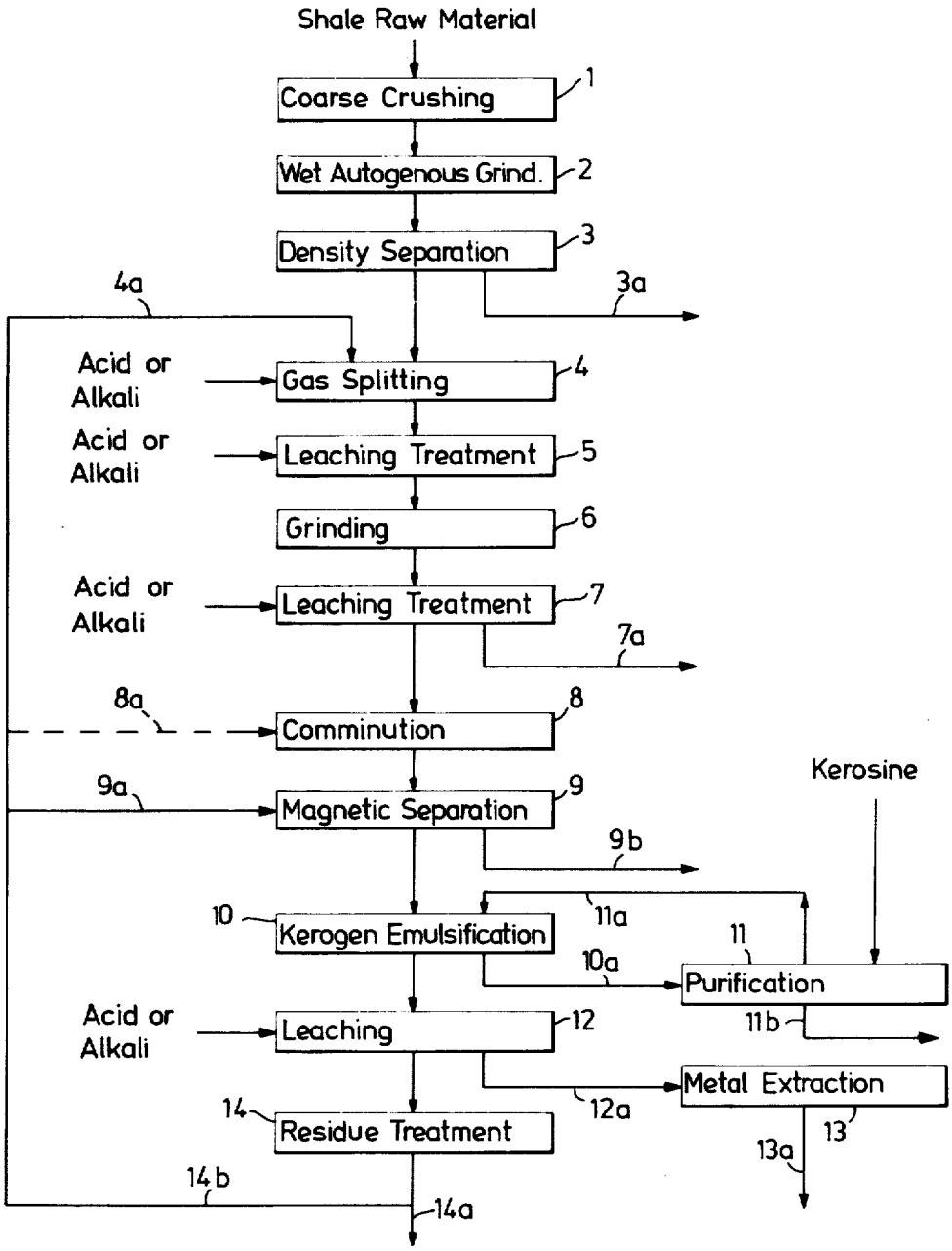
Shale Raw Material
Coarse Crushing
1
Wet Autogenous Grind.
2
Density Separation
3
3a
4a
Acid or Alkali
Gas Splitting
4
Acid or Alkali
Leaching Treatment
5
Grinding
6
Acid or Alkali
Leaching Treatment
7
7a
8a
Comminution
8
9a
Magnetic Separation
9
9b
Kerosine
10
Kerogen Emulsification
11a
11
10a
Purification
Acid or Alkali
Leaching
12
11b
Metal Extraction
12a
14
Residue Treatment
13
13a
14b
14a

METHOD OF TREATING SHALES

This is a continuation of application Ser. No. 778,966 filed Mar. 18, 1977, now abandoned.

The present invention relates to a method of recovering kerogen from bituminous sedimentary rock, in particular oil shales and alum shales, in which the shale is crushed and then finely divided in at least one stage, to a particle size of sufficient fineness to enable the major portion of the kerogen and any sulphides present to be separated out.

Bituminous sedimentary rock, such as oil shales and alum shales represent a significant reserve of mineral raw materials from which energy can be recovered. These rocks have a predominantly fine-grain structure and contain in the interstices between the grains valuable constituents in the form of bituminous residues, which may also be of extremely fine-grain form. The shales may also contain other inorganic constituents of greater or lesser value in the form of different minerals. Thus, oil shales and alum shales comprise a matrix of fine-grain clay rock often exhibiting the grain size smaller than 10 μm. The organic constituents of oil shales and alum shales are generally designated kerogen, which is a mixture of stabilised, dry and solidified hydro-carbons produced by the sedimentation of organic substances. The inorganic constituents may be pyrites and minor quantities of metals such as uranium, copper, nickel, cobalt, vanadium and molybdenum, these metals being present in the form of corresponding sulphides, silicates and phosphates for example.

Hitherto, the extraction of kerogen constituents of oil shale and alum shale for useful purposes on a technical scale, has been based on heating or combusting the shale. In the former case it has been possible to separate oil by pyrolysis or destillation processes, while in the latter case the kerogen are gasified, the resultant gas also containing substantially carbon monoxide, methane and hydrogen, and also significant quantities of hydrogen sulphide, sulphur dioxide and other sulphur-carbon-oxygen compounds. This method of recovering kerogen from kerogen-bearing shales has hitherto presented serious technical difficulties, primarily because of the sulphur content of the oil shale and alum shale, and also because of the high content of non-combustible materials of these shales. The kerogen content seldom exceeds 15–25% by weight. These circumstances limit the utility of said raw materials quite considerably, and thus there is need of a practical method of separating kerogen from the inorganic constituents of the shales.

An object of the present invention is to provide a simple and economic method by which kerogen and optionally other constituents, such as pyrites, can be physically separated from fine-grain sedimentary rock, particularly from shales.

Methods by which organic materials, such as carbon, can be physically recovered from carbonaceous products are described, for example, in the U.S. Pat. Nos. 1,420,164 and 1,421,862, according to which methods the organic material is recovered by emulsifying said products with oil. These methods were later applied by Quass (J.Inst.Petr. Vol. 25 page 813/1939) to kerogen-containing materials, the materials being ground in the presence of water to a particle size smaller than approximately 75 μm, whereafter oil was added. The oil formed with the kerogen a mass having a dough-like consistency, this mass being removed and then washed with water whilst being stirred, whereafter the oil was removed by washing the mass first with benzine and then with carbon tetrachloride. Proposals have also been made for recovering kerogen by means of froth flotation techniques. One method for recovering kerogen from Swedish alum shales has been described by Rynninger (Svenska Föreningen för lerforskning, Bd 79, H. 1 (1957) pages 88–90). This method, which has only been carried out on a laboratory scale and which is a modification of the Quass method, involves an excessive fine-grinding of the shale, batchwise in water, the shale being ground to a particle size lying between 0.1–10 μm whilst adding kerosine to emulsify the kerogen content.

As with the case of recovering kerogen, in order for the separating process to be thorough and complete, said process being, for example, a flotation, selective emulsification or magnetic separation process, for recovering, for example, pyrites, the matrix and the different minerals contained therein must first be crushed to substantially free the minerals. When the raw material is shale, it is often necessary, in this respect, to grind the material to a particle size in the order of magnitude of 15 to 10 μm. The energy required to grind the material to such particle sizes, however, is particularly high when the shales have not previously been treated. When applying conventional grinding processes, an energy input of between 100 and 150 kWh/ton of treated material is required to crush untreated shale to free the ores therein. The reason why such a high energy input is required, is mainly due to the particular structure and elastic properties of the material, rendering it unsuitable for fine-grinding in a ball mill. Shale material has predominantly a stratified structure and the minerals incorporated therein are relatively soft and only slightly brittle, said minerals being more elastic than brittle, which renders it difficult to obtain a high grinding efficiency when grinding such minerals in conventional ball mills.

The present invention enables bituminous sedimentary rock, such as alum shale and the like, to be finely divided and crushed so as to release the minerals therein, in a manner which is both simple and energy saving, thereby enabling kerogen, pyrites and other separable constituents to be recovered substantially completely, in a cost-saving manner. This is achieved in accordance with the invention by the fact that the sedimentary rock is subjected, at least prior to the final finely-dividing step, to a leaching treatment in order to enable the rock to be more readily divided. In the leaching treatment, the leaching liquid attacks the boundary zones of adjacent grains of the matrix, thereby to weaken the mechanical bonds between said grains, these zones predominantly comprising minerals which are cemented together. Subsequent to the final finely-dividing stage, the kerogen content can be separated out by emulsification, flotation or density-separation processes in accordance with, for example, the sink and float principle.

In the latter case, the separation fluid may, to advantage, comprise a substantially non-polar, water-immiscible liquid which is substantially inert in the present context, said liquid having a density greater than the density of the kerogen, the density of the liquid exceeding 1.0 and, for example, reaching to approximately 1.3–1.5. The separation process can be promoted by subjecting the material to centrifugal forces and may be carried out, for example, in a centrifuge. By the expression substantially non-polar liquid is meant here, and in the following, a liquid which, when compared with water, exhibits a low dielectric constant and/or a low dipole moment with subsequently small hydrogen-binding tendencies. For example there can be used a liquid having a dielectric constant and/or a dipole moment of at most approximately two thirds and suitably at most one half the dielectric constant and dipole moment of water. Thus, the invention enables a relatively pure concentrate of kerogen to be produced, i.e. a kerogen having a low sulphur and ash content, which kerogen, with simplified process steps, can be made suitable for treatment by pyrolysis or gasification processes.

Subsequent to the leaching stage, the material can be finely divided by means of a wet-grinding process, for example by so-called pebble-grinding. In certain instances, grinding stones made of lime-stone are preferred, since lime-stone worn from the grinding stones will neutralize the acid residues from a preceeding leaching process and will provide the material with an addition of particulate lime-stone. The liquid used in the grinding operation may be water or any other liquid capable of being used for the aforementioned emulsifying or separating process.

Subsequent to weakening the mechanical bonds between the minerals contained in sedimentary rock in the aforementioned leaching process, the rock may be finely-divided in at least one stage by a gas-splitting process, i.e. a process in which the rock is subjected to pressure in the presence of a gas and the pressure then removed, whereupon the expanding gas will disintegrate the mechanical bonds of the grains. The expansion medium used in the gas-splitting process may be water, although said medium may, very advantageously, comprise liquid used in the preceding leaching operation and remaining in the material. Preferably, the leaching liquid used in the leaching treatment is one capable of selectively leaching out metals from the starting material. The leaching treatment is suitably effected at elevated temperatures with acids, such as sulphuric acid, nitric acid or hydrochloric acid, although basic solutions, such as soda solutions and ammoniacal solutions may also be used. Substances, such as certain metals leached from the starting material are suitably separated successively in the form of a leaching solution. Thus, for example uranium, vanadium, aluminium and phosphate ions can be separated by extraction from the solution in this way.

When the material subjected to a leaching treatment has a high content of sulphide minerals, the material may be subjected to a process for selectively separating the sulphide minerals therefrom, subsequent to finely dividing the starting material and prior to separating kerogen therefrom. When the sulphide minerals respond to magnetic forces, i.e. comprise mainly pyrites, they may be separated by magnetic separation techniques, for example by means of the so-called HGMS technique (High gradient magnetic separation). Alternative separating methods include selective flotation and selective flocculation processes. Alternatively, by using a suitable surfactant, pyrites and other sulphides can be emulsified together with the kerogen and the sulphide minerals and kerogen subsequently separated one from the other. Subsequent to recovering the kerogen and sulphide minerals by applying, for example, one of the aforementioned methods, the starting material undergoing said treatment is suitably subjected to a further leaching operation to selectively leach out metals. When no further leaching stages or separating stages are to be applied, the residual starting material is suitably passed to an agglomerating stage, in which the residual material is agglomerated and converted to a form in which it can be discarded in a manner satisfactory from the environmental aspect, or can be used, for example, as ballast for ground foundation work. When the residual starting material contains limestone, for example limestone worn from grinding bodies made of limestone, mechanically strong agglomerates can be obtained simply by adding sulphuric acid.

The invention will now be described in more detail with reference to working examples using Swedish alum shales containing separatable constituents, inter alia, kerogen, pyrites and uranium-containing minerals, and with reference to a block diagram of a suitable plant illustrated in the accompanying drawing.

The incoming alum shale to be treated is first subjected to a primary disintegrating process in which the shale is disintegrated to a particle size of approximately 3–10 mm. This can be effected in jaw-crushers, cone-crushers, impact-crushers and in rod-mills in a manner known per se. Preferably the starting material is primarily disintegrated in a system comprising a coarse-crushing stage and an autogenous grinding stage, in which system the material can be divided to a particle size smaller than 10 mm and, if so desired, smaller than 3 mm. It is, at times, suitable to separate limestone from the material thus ground by subjecting said material to sink and float separating processes in cyclones. When the size of the particles is $<0.5$ mm, the limestone is preferably separated from the ground material by density-separation techniques in substantially non-polar liquids. It would now require an input energy of approximately 100–120 kWh/ton to further grind the product to a particle size below 15 $\mu$m, which input energy, however, can be reduced by at least approximately half by applying the method according to the invention in the continued working stages.

Thus, in accordance with the invention, the material is now charged to a leaching circuit. The leaching treatment is preferably effected at elevated temperatures, for example temperatures above 50° C. Water and acid or alkali are added to the leaching circuit to obtain a suitable acid or alkali concentration. Acid or alkali will attack the grain boundaries of the minerals present in the material and weaken the mechanical bonds of the minerals at said boundaries. At the same time minerals present along the stratified layer surfaces of the shale material are also loosened to a certain extent, thereby undermining the structure of the rock causing the same to disintegrate.

Leaching can be effected either with the material lying in sumps or by passing the material, in mixture with leaching liquid, slowly through a vertical column (silo-leaching), or by agitating the material together with a leaching liquid in a quantity sufficient to render the material fluid, in mixing tanks, thickeners or tube reactors. Other leaching methods may also be used, of course. In order to break down the physical bonds of the particle grains, it is an advantage to subject the material to minor grinding stages at suitable intervals. These grinding stages may have the form of vibration-grinding stages using balls, or of drum mill grinding stages using balls. The combined effect of the leaching treatment and the mechanical grinding operation causes the physical bonds between the minerals to be broken more rapidly and with the minimum of input energy. The amount of input energy and the length of time over which it is effective is determined by the property of the material and the concentration and temperature of the leaching agent, and the treatment is continued until the minerals contained in the shale are freed practically to the extent desired.

Prior to the leaching stage there may be a pre-treatment stage in which material, which has been subjected to preparatory crushing and grinding operations, is subjected to a maturing operation in which the different strata of the shales are split up. This pre-treatment stage advantageously comprises a so-called gas-splitting stage, in which the incoming material to be treated is heated in a closed pressure vessel in the presence of a suitable vapour to obtain a vapour pressure of approximately 0.4–1 MPa. The vapour may comprise, for example, steam, although it is also possible to use a vaporized acid or a vaporized alkali active as a leaching agent. The material is then permitted to flow rapidly from the pressure vessel together with saturated vapour, whereupon the material explodes as a result of the effect of the expanding vapour thereon. In this way the shale material is weakened and the different mineral layers therein are exposed. In the present instance the material is impregnated at the same time with leaching agent. It is not necessary, however, to subject the material to such a gas-splitting operation, but that the maturing process may be effected by placing the material in the open air. The effect obtained when weathering the material in the open air, is the same as that obtained when subjecting said material to a gas-splitting process, although the former process is a particularly lengthy one and requires a large amount of space, besides being less favourable from the environmental aspect.

When the leaching treatment is effective to selectively leach certain substances, such as uranium and vanadium, from the shale material, the substances being taken up in the leaching solution, it may be desirable to free the solution from these substances. In this respect, liquid-liquid extraction or ion exchange process may be used. Such extraction stages are primarily preferred, in which dissolved substances can be recovered (extracted) without the liquid in its entirety being separated and clarified, whereby no leaching-liquid exchange need take place. The shale which has been disintegrated by the combination of leaching and grinding operations to the desired particle size, e.g. down to approximately 15 μm, so as to free the minerals contained in the shale to the desired extent, is subjected to a selective separation stage, suitably subsequent to adding water, said stage being enabled by the extent to which the starting material has been crushed and the minerals therein freed. A suitable method of procedure is one in which the finely-divided shale is first passed through a magnetic separation stage having a magnetic flux density of over 2000 Gauss (0.2 T), whereby pyrites together with cobalt, nickel, copper and other metals bound therein can be selectively separated as a result of their magnetic properties. The shale freed from pyrites now contains kerogen, clay minerals and residues of other minerals not leached out from the shale, while the leaching residue will contain residues of dissolved metal salt, when these have not been previously extracted. A wetting agent comprising a strongly anionic polar substance is added to the mass of finely-ground shale, either during the grinding operation or thereafter, said substance strengthening the water-bond occurring between the clay minerals and the molecules of water. At the same time as the wetting agent is added, or after adding the wetting agent, the mass is admixed with a substantially non-polar liquid substance which is substantially water immiscible said substance being kerosine, benzene, perchloroethylene or the like, whereafter the mass is stirred. As a result of the wetting conditions, the substantially non-polar liquid will not wet the clay mineral particles wetted by the water, but will wet the kerogen particles, which consequently emulsify in the non-polar phase, which due to the fact that it is water-immiscible forms an individual phase separate from the water phase. The emulsion comprising kerogen and non-polar liquid is lighter than the water-clay mineral suspension and thus floats to form a scum or a coating on the latter, from which the emulsion can be selectively removed. The thus obtained emulsified concentrate of kerogen and substantially non-polar liquid can be subjected to a purification process by treatment with water, further non-polar liquid, or both, whereby separation between, on one hand kerogen and non-polar liquid, and on the other hand water and clay minerals is amplified. In this respect, the process is similar to known repetition sequences within the flotation technique. Thus, minor re-grinding stages can be arranged between the purification stages. Kerogen-containing fractions which do not have the desired degree of purity are returned to the emulsification stage.

The amount of substantially non-polar liquid required to effect the emulsifying process is normally at least 0.5–1 times the volume of kerogen. It may, at times, be desirable, however, to use much larger quantities of non-polar liquid. This is particularly the case when the leaching treatment is effected in the form of a sump-leaching process or a silo-leaching process, in which the liquid content of the material obtained from the grinding stage and from the leaching stage is so low that it is not possible to obtain a consistency suitable for emulsifying purposes by adding only minor quantities of non-polar liquid. In such cases, in order to obtain the correct fluidity, it may be desirable, as early as during the grinding process, to add a larger quantity of emulsifying liquid than that mentioned. Since the emulsifying liquid is immiscible with the remaining suspension, it can readily be separated in a later stage from the suspension phase containing the mineral particles. By means of this method it is possible to separate the kerogen with a minimum quantity of water in the suspension as compared with flotation, which is to great advantage, since water can only be separated from the material residue remaining from the separation with difficulty.

In the illustrated example, pyrites have been recovered magnetically prior to the kerogen extraction stage. It is possible however, to carry out these treatment stages in the reverse order, e.g. to first carry out the kerogen extraction stage and then a pyrite separation stage. Pyrites can be separated not only by the aforementioned magnetic separation process, but also by different types of selective flotation or selective flocculation in accordance with known techniques.

A further alternative is to add to the finally fine-divided shale mass a substance which causes sulphide minerals to be wetted by substantially non-polar liquids, and a non-polar liquid active as a sulphide emulsifier and kerogen emulsifier, such as kerosine, wherewith both sulphide minerals and kerogen are emulsified simultaneously in the extraction stage. This mixed emulsion can be washed with, for example, kerosine, whereafter insufficiently purified kerogen together with part of the kerosine are separated out and returned to the extraction stage. By subjecting the remaining emulsion to a highly-intensive magnetic separation process, the emulsion can be divided into a part containing sulphide minerals and a certain quantity of kerosine added thereto, and a residual part containing the purified kerogen and the major portion of kerosine, which residual part can be further purified by treating the same with water and/or kerosine in the aforedescribed manner. The purified kerogen can be separated from the substantially non-polar liquid by centrifuging, for example, whereafter the remaining portion of the liquid is recovered by evaporating the same.

Subsequent to carrying out the separation stages, there remains a residue of substantially clay minerals free from sulphides, kerogen and a part of its releasable metal content. Owing to the extent to which the material has been finely divided, the material is now particularly reactive, and hence the residual material can be readily subjected to a further leaching stage. This leaching stage may have the form of an acid or an alkaline leaching process similar to the aforedescribed leaching stages. Thus, in order to obtain optimal leaching of leachable constituents it is possible, subsequent to separating kerogen and pyrites, to considerably increase the temperature of the leaching process, for example to a temperature of from 100° to 300° C., and also to increase the leaching pressure, whereby the desired leaching result can be obtained very quickly. The leaching process is preferably carried out in pressure reactors, suitably in tube-reactors.

In the plant illustrated in the drawing, shale raw material is introduced to a coarse-crushing stage 1 in which the shale is subjected to a primary cross-crushing operation, whereafter the shale is subjected to a wet, autogenous grinding operation in a stage 2, in which stage the material is ground to a maximum particle size of between 3 and 10 mm. The ground product is then introduced to stage 3 in which it is subjected to a density-separation operation in accordance with the sink and float principle, wherewith the limestone present in the shale material (stinkstone), which limestone forms a sink product and is separated and removed at 3*a*. The float product is passed to a gas-splitting plant 4, to which water is passed via a pipe 4*a* and to which may also be passed an acid solution or alkali solution of the type used in later stages for dissolving the material. The material, finely-divided and made porous in the gas-splitting stage, is then leach-heated in a stage 5, to which a leaching liquid is passed, said leaching liquid being an acid solution or an alkali solution. The shale material, which has been broken-up still further in the leaching treatment, owing to the fact that the physical bonds of the material have been weakened by said treatment, is then ground in a grinding stage 6. The leaching treatment, such as the leaching treatment of stage 5, and the subsequent grinding process, such as the grinding process of stage 6, can be repeated one or more times depending upon the nature of the incoming material. Subsequent to passing the final grinding stage, the shale is then leach-treated with an acid or an alkali in stage 7, from which leaching solution is removed through a pipe 7*a* to a stage (not shown) in which metals, such as uranium, vanadium, and molybdenum, dissolved in the solution are extracted therefrom, for example by liquid-liquid extraction or ion exchange operations. The leaching residue, which may have a solid form or the form of a slurry, is then passed to a further stage 8 in which the residue is finally comminuted, in which operation the mass particles are further divided to a particle size of about 15 μm, which is suitable for physical separation purposes. The final comminuting stage 8 may comprise a single stage or two or more part-stages. At least one of the stages or part stages may, in this case, comprise a gas-splitting operation of the aforedescribed type. If further water is required, this is passed to the comminuting stage 8 through a pipe 8*a*. The shale finely-divided in stage 8 is then subjected to a highly-intensive magnetic-separation operation in stage 9 whilst adding water, said water being passed through a pipe 9*a*, pyrites being separated off and removed through a pipe 9*b*. The magnetic separating stage may, however, be replaced by a flotation or emulsification stage. The water in stages 8 and 9 can be replaced by a substantially non-polar liquid, such as kerosine.

The shale from which pyrites have been separated is moved to a stage 10 in which kerogen is separated from the shale by forming an emulsion with the aid of kerosine passed to the stage 10 via a purification stage 11 and a pipe 11*a*. The crude emulsion containing kerogen and kerosine and floating to the surface during the emulsifying process is transferred to the aforementioned purification stage 11 through the pipe 10*a*. Kerosine is charged to the purification stage, whereupon the crude emulsion is divided into a kerosine-phase containing a more second-grade kerogen, this phase being returned to the emulsification stage 10 through the pipe 11*a*, and a kerogen concentrate which also contains kerosine. This latter phase is removed through the pipe 11*b* for separating the kerosine from the kerogen. The kerosine recovered in this separation stage may replace the water in stages 8 and 9 and may also be passed to the kerogen emulsification stage 10 or the purification stage 11. In certain cases it is preferred to permit kerogen and kerosine to form a mixture of finished concentrate which can be used as fuel for drying and gasifying purposes or in, for example, metallurgical reduction processes. Subsequent to the extraction of kerogen, the shale residue is then leached in one or more stages 12 to recover desired metals therefrom, whereafter the leaching solution is passed through a pipe 12*a* to a metal extraction stage 13 in which the metals are extracted from said solution, which extraction stage may comprise an ion exchange or a liquid-liquid extraction stage, from which recovered extracted metals are removed, as indicated by the arrow 13*a*. Leaching solution from which metal have been extracted can be regenerated and re-used.

The liquid content of the leaching residue from stage 12 is driven off and the solid residue agglomerated in stage 14, wherewith the water or other liquid which has been driven off is removed via a pipe 14*b* and returned to previous process stages, 4*a*, 8*a* and/or 9*a*. The desiccated and compacted leaching residue is removed as indicated by arrow 14*a*, either to be deposited or to be re-used.

The described method provides a way of recovering, with a high degree of selectivity, all or a major number of the valuable constituents of a complex, fine-grain material, such as bituminous sedimentary rocks, particularly alum shale. The balance between leaching and grinding stages depends upon which substances the starting material contains. In certain cases it is desirable to subject the material to exhaustive leaching processes between respective grinding stages to enable desired metals to be recovered as quickly as possible and, at the same time, to make the material easy to grind. In other cases it may be suitable to subject the material to only minor leaching attacks whilst relying on the mechanical grinding of the material to comminute said material to the extent desired and to subject the material subsequent to recovering sulphides and kerogen therefrom to an exhaustive leaching process. This latter method is often to be preferred, in which the material is crushed to promote selective extraction of pyrites and kerogen and then subjected to a rapid leaching operation.

The method according to the invention can generally be used for shale-containing rock and ores, in which it is desired to exhaustively crush the material at a low input energy. In this instance, the weakening of the mechanical bonds of the minerals by leaching liquids, as described in respect of alum shales, is extremely favourable, and hence the method can be applied when ever one or more of the aforedescribed effects is desired when treating a material to be subjected to selective flotation, magnetic separation, extraction and exhaustive leaching treatment.

I claim:

1. A method of recovering kerogen from bituminous sedimentary rock comprising crushing the sedimentary rock and finely-dividing the crushed rock in a plurality of comminuting stages to a particle size of a fineness sufficient to substantially free the major part of the kerogen and any sulphides present in the rock so as to permit a subsequent separation of kerogen and any sulphides, subjecting the sedimentary rock, at least prior to the final one of said comminuting stages, to a leaching treatment with a leaching solution selected from acidic and basic solutions operative to selectively weaken mechanical bonds between minerals contained in said sedimentary rock to enable said rock to be more readily divided in said final comminuting stage, and subsequent to said final comminuting stage, recovering kerogen and any sulphides by physically separating the same from the leached and finally comminuted rock.

2. A method according to claim 1, wherein the kerogen is physically separated by an emulsification process.

3. A method according to claim 1, wherein the kerogen is physically separated by a flotation process.

4. A method according to claim 1, wherein the kerogen is physically separated by a density-separating process.

5. A method according to claim 4, wherein the density-separating process is effected in accordance with the sink and float principle while using a substantially non-polar liquid having a density exceeding the density of the kerogen as a separation fluid.

6. A method according to claim 1, wherein the sedimentary rock is finely-divided in at least the final comminuting stage by subjecting the rock remaining after the leaching treatment to a gas-splitting process comprising subjecting the rock to pressure in the presence of a gas and subsequent removal of the pressure to cause expansion of the gas, which will disintegrate said mechanical bonds.

7. A method according to claim 1, further comprising separating selectively sulphides present in the leached rock prior to the kerogen separation.

8. A method according to claim 1, wherein metals selected from the group comprising uranium, molybdenum, aluminum and vanadium are leached out from said rock by said leaching treatment with a suitable leaching liquid for selectively leaching metals from said rock.

9. A method according to claim 7, in which the minerals can be influenced magnetically, wherein the sulphides are separated by means of a magnetic-separation process.

10. A method according to claim 7, wherein the sulphides are separated by means of selective flotation.

11. A method according to claim 7, wherein the sulphides are separated by means of selective flocculation.

12. A method according to claim 1, comprising subjecting the sedimentary rock, subsequent to separating kerogen and sulphides therefrom, to a further leaching treatment to selectively recover metals therefrom.

13. A method according to claim 1, further comprising agglomerating the sedimentary rock remaining subsequent to separating kerogen and any sulphides and metals therefrom.

* * * * *